US005954255A

United States Patent [19]

Beebe et al.

[11] Patent Number: 5,954,255

[45] **Date of Patent: *Sep. 21, 1999**

[54] DUAL STRAP ARRANGEMENT FOR GOLF BAGS

[75] Inventors: Jay N. Beebe, Phoenix; Parvaneh Kazemi-Tabrizi, Scottsdale, both of Ariz.

[73] Assignee: Karsten Manufacturing Corporation, Phoenix, Ariz.

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,062

[22] Filed: Oct. 2, 1997

Related U.S. Application Data

[63] Continuation of application No. 08/556,253, Nov. 13, 1995, abandoned.

[51] Int. Cl.[6] ..... A45F 3/04; A63B 55/00

[52] U.S. Cl. ..... 224/645; 224/643; 224/628; 206/315.3

[58] Field of Search ..... 224/627, 629, 224/643, 645, 633, 259, 628; 206/315.3

[56] References Cited

U.S. PATENT DOCUMENTS

| | | | |
|---|---|---|---|
| 1,570,500 | 1/1926 | Kennedy | 224/633 |
| 1,816,262 | 7/1931 | Ritter | 224/259 |
| 1,951,492 | 3/1934 | Schneider . | |
| 2,533,440 | 12/1950 | Endee . | |
| 2,820,498 | 1/1958 | Endee . | |
| 2,853,111 | 9/1958 | Williams . | |
| 3,622,056 | 11/1971 | Droeger . | |
| 5,038,984 | 8/1991 | Izzo . | |
| 5,042,703 | 8/1991 | Izzo . | |
| 5,042,704 | 8/1991 | Izzo . | |
| 5,269,449 | 12/1993 | Sattler . | |
| 5,348,205 | 9/1994 | Steurer . | |

*Primary Examiner*—Linda J. Sholl
*Attorney, Agent, or Firm*—Darrell F. Marquette

[57] ABSTRACT

A dual strap arrangement for golf bags includes a first shoulder strap (20) having an upper end (24) attached to a generally tubular body (11) of a golf bag (10) at a first location (26) proximate a top end (12) of the body (11) and a lower end (28) attached to the tubular body (11) at a second location (30) generally intermediate the body top end (12) and a bottom end (14) of the body (11). The first location (26) is on one side of a spinal axis (15) that extends longitudinally between the body top and bottom ends (12, 14), and the second location (30) is on the other side of the spinal axis (15) so that a straight line (27) extending between the first and second locations (26, 30) traverses the spinal axis (15). A second shoulder strap (22) has upper and lower ends (32, 34) attached to the body (11) at third and fourth locations (36, 38), respectively. The third location (36) is circumferentially spaced from the first location (26) but it is on the same side of the spinal axis (15) as the second location (30), and the fourth location (38) is circumferentially spaced from the second location (30) but it is on the same side of the spinal axis (15) as the first location (26) so that a straight line (37) extending between the third and fourth locations (36, 38) also traverses the spinal axis (15). When the golf bag (10) is carried by a person with the first shoulder strap (20) looped over one shoulder and the second shoulder strap (22) looped over the other shoulder, the shoulder straps (20, 22) are arranged to cross each other at an intersection point (48) and form an X-shaped pattern (50) on the person's back.

9 Claims, 5 Drawing Sheets

DUAL STRAP ARRANGEMENT FOR GOLF BAGS

This application is a continuation of application Ser. No. 08/556,253, filed Nov. 13, 1995, now abandoned.

BACKGROUND OF THE INVENTION

This invention relates generally to golf equipment and, in particular, to a dual strap arrangement for golf bags.

Conventional golf bags for carrying golf clubs have a single shoulder strap that may be looped over either shoulder of a person carrying the golf bag. Since conventional golf bags are supported on only one shoulder at a time, there is a tendency for undue shoulder fatigue and soreness. Therefore, golf bag strap systems which minimize or eliminate such undue shoulder fatigue and soreness are desirable.

U.S. Pat. No. 2,853,111 to A. K. Williams discloses a golf bag with a pair of shoulder straps arranged side by side. Each strap has one end permanently fastened to the golf bag and another end detachably connected to the golf bag by a buckle. Although the Williams strap arrangement permits a golf bag to be carried by a person on both shoulders, it is unsuitable when a person desires to carry the golf bag on only one shoulder.

U.S. Pat. No. 5,042,704 to T. J. Izzo discloses a strap carrying system for golf bags including a single shoulder strap that is connected to a golf bag at three longitudinally spaced locations to provide a pair of loops which may be supported on a person's shoulders. The Izzo system permits a person to carry a golf bag utilizing both shoulders instead of only one shoulder which has been customary. With the Izzo system installed, carrying a golf bag on only one shoulder is inconvenient because the golf bag will not be properly balanced.

U.S. Pat. No. 5,269,449 to W. A. Sattler discloses a supplemental carry strap for use on golf bags having a handle and a single shoulder strap. The supplemental carry strap of Sattler includes a shoulder element connected to a coupling element which is connected by a hook and loop device to the golf bag handle. U.S. Pat. No. 5,348,205 to S. T. Steurer discloses a strap arrangement for golf bags consisting of two shoulder straps adapted for connection to a handle on a golf bag. Another embodiment of the Steurer s trap arrangement includes a secondary shoulder strap which is connected to a golf bag handle. The Sattler and Steurer straps are primarily intended for retrofitting existing golf bags with an auxiliary shoulder strap.

SUMMARY OF THE INVENTION

The preferred embodiment of the present invention provides a dual strap arrangement for use in combination with a golf bag for carrying golf clubs. The golf bag includes a generally tubular body with a top end, a bottom end, and a spinal axis extending between the top and bottom ends. The dual strap arrangement comprises a first shoulder strap having an upper end attached to the body at a first location which is on one side of the spinal axis and a lower end attached to the body at a second location which is on the other side of the spinal axis so that a straight line extending between the first and second locations traverses the spinal axis. The first location is proximate the body top end, and the second location is generally intermediate the body top and bottom ends. The second shoulder strap has opposite ends attached to the body at third and fourth locations. Another straight line extending between the third and fourth locations also traverses the spinal axis since the third location is on the same side of spinal axis as the second location while the fourth location is on the same side of the spinal axis as the first location.

The opposite ends of the second shoulder strap include an upper end attached to the body at the third location and a lower end attached to the body at the fourth location. The third location is circumferentially spaced from the first location, and the fourth location is circumferentially spaced from the second location. When the golf bag is carried by a person with the first shoulder strap looped over one shoulder of the person and the second shoulder strap looped over the other shoulder of the person, the first and second shoulder straps are arranged to cross each other and form an X-shaped pattern on the person's back. Preferably, the shoulder straps are arranged so that they cross each other at an intersection point that is substantially midway between the person's shoulders.

The dual strap arrangement may also comprise first adjustment means for adjusting the overall length of the first shoulder strap which is measured between the first and second locations, and second adjustment means for adjusting the overall length of the second shoulder strap which is measured between the third and fourth locations. The first adjustment means is preferably disposed on the lower end of the first shoulder strap, and the second adjustment means is preferably disposed on the lower end of the second shoulder strap.

DESCRIPTION OF THE PREFERRED EMBODIMENT

Figure 1:
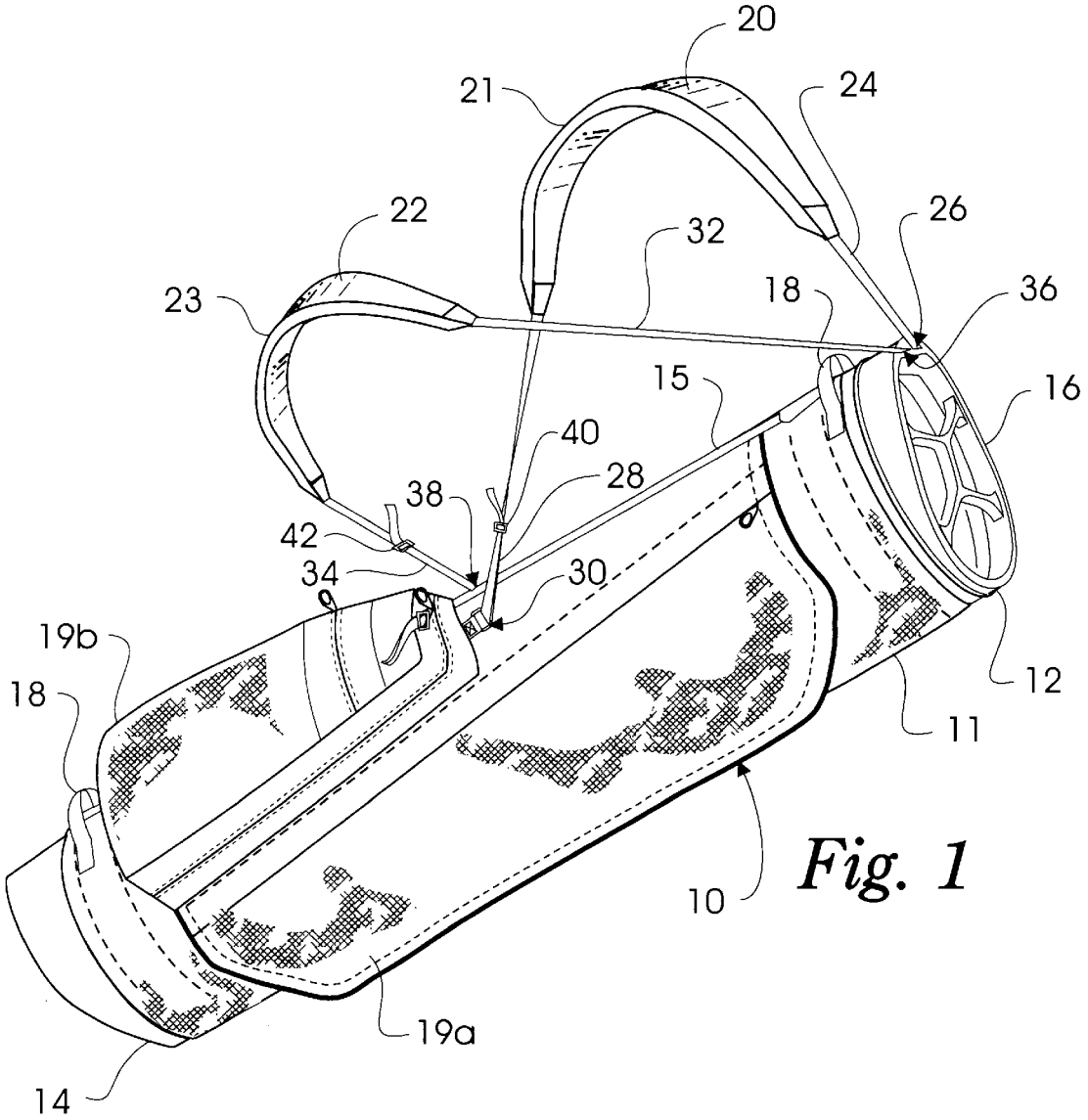
FIG. 1 is a perspective view of a golf bag embodying a dual strap arrangement according to the preferred embodiment of the present invention.
Figure 2A:
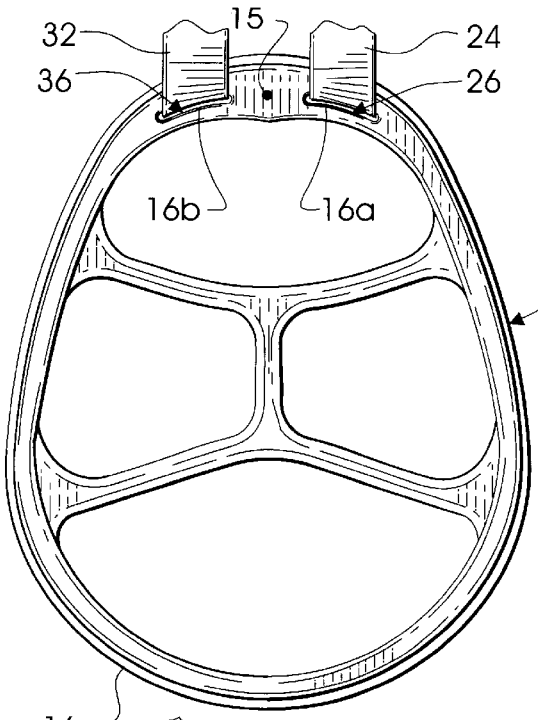
FIG. 2*a* is an enlarged top end view of the golf bag shown in FIG. 1.
Figure 2:
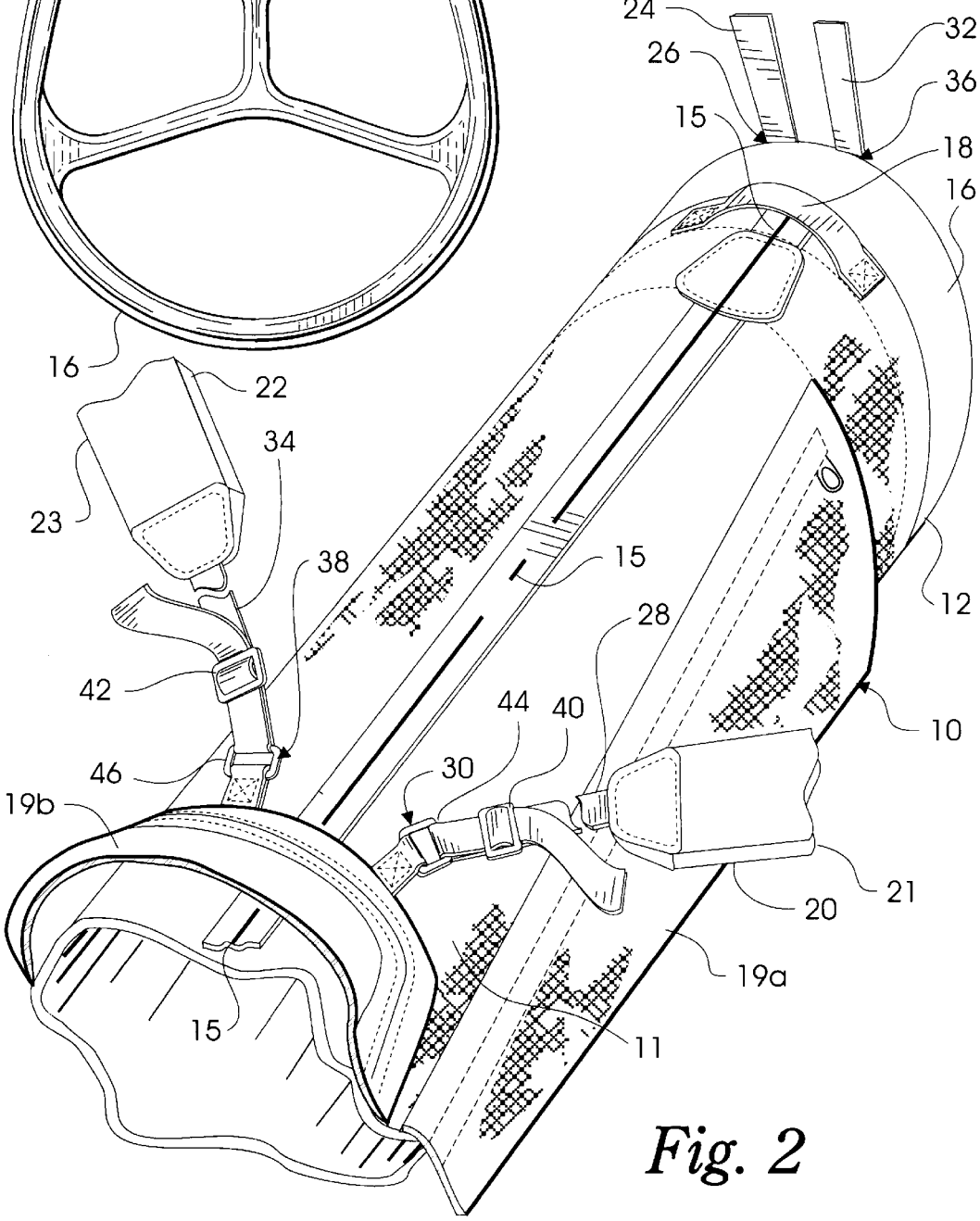
FIG. 2 is an enlarged partial view of the dual strap arrangement shown in FIG. 1.

Referring to FIGS. 1 and 2, a golf bag 10 for carrying golf clubs has a generally tubular body 11 with a top end 12, a bottom end 14, and a spinal axis 15 extending longitudinally between the top and bottom ends 12, 14. The top end 12 of the body 11 is defined by a throat structure 16 similar to that disclosed in U.S. Pat. No. 4,596,328 to John A. Solheim. Golf clubs 13 may be inserted into and removed from the body 11 through the top end 12 in conventional manner. A pair of handles 18 are provided on the body 11 near its top and bottom ends 12, 14. The golf bag 10 has accessory pockets 19*a*, 19*b* mounted on the body 11.

Figure 3:
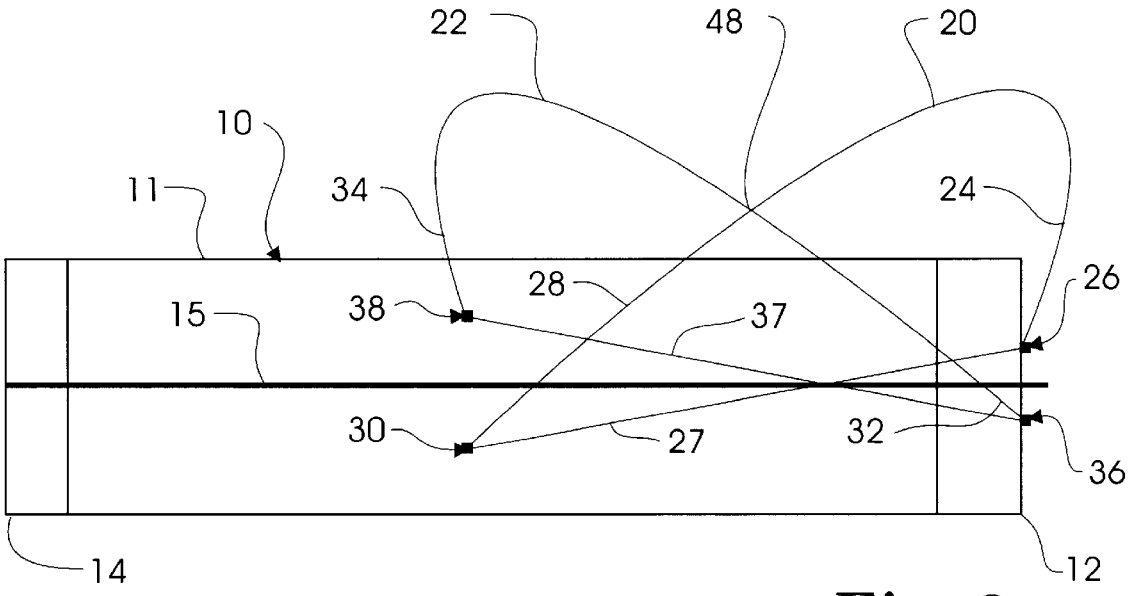
FIG. 3 is a schematic view of the dual strap arrangement shown in FIG. 1.

The golf bag 10 has a dual strap arrangement which includes a first shoulder strap 20 and a second shoulder strap 22. The first shoulder strap 20 has an upper end 24 attached to the body 11 at a first location 26 proximate its top end 12 and a lower end 28 attached to the body 11 at a second location 30 generally intermediate its top and bottom ends 12, 14. The first shoulder strap 20 includes an elongated pad 21 between its upper and lower ends 24, 28. As best seen in FIG. 3, the first location 26 is on one side of the spinal axis 15 while the second location 30 is on the other side of the spinal axis 15. This orientation of the first and second locations 26, 30 causes a straight line 27 extending between the first and second locations 26, 30 to traverse the spinal axis 15 since the first and second locations 26, 30 are on opposite sides of the spinal axis 15. The second shoulder strap 22 has upper and lower ends 32, 34 attached to the body 11 at third and fourth locations 36, 38, respectively. The second shoulder strap 22 includes an elongated pad 23 between its upper and lower ends 32, 34. The third location 36 is on the same side of the spinal axis 15 as the second location 30 and it is circumferentially spaced from the first location 26. The fourth location 38 is on the same side of the spinal axis 15 as the first location 26 and it is circumferentially spaced from the second location 30. This orientation of the third and fourth locations 36, 38 causes a straight line 37 extending between the third and fourth locations 36, 38 to also traverse the spinal axis 15 since the third and fourth locations 36, 38 are on opposite sides of the spinal axis 15.

Referring to FIGS. 2 and 2*a,* the first shoulder strap 20 has an adjustment device 40 disposed on its lower end 28 for adjusting the overall length of the strap 20 which is measured between the first and second locations 26, 30. Likewise, the second shoulder strap 22 has an adjustment device 42 disposed on its lower end 34 for adjusting the overall length of the strap 22 which is measured between the third and fourth locations 36, 38. By utilizing the adjustment devices 40 and 42, the shoulder straps 20 and 22 may have their overall lengths adjusted independently as desired. Further adjustment devices (not shown) may be provided on the upper ends 24, 32 of the shoulder straps 20, 22 in addition to, or in lieu of, the adjustment devices 40, 42. The upper ends 24, 32 of the straps 20, 22 are secured in slots 16*a,* 16*b* formed in the throat structure 16 at the first and third locations 26, 36. The lower ends 28, 34 of the straps 20, 22 extend through rings 44, 46 mounted on the body 11 at the second and fourth locations 30, 38. Alternatively, the strap lower ends 28, 34 could be sewn directly to the body 11 at the locations 30, 38 thereby eliminating the rings 44, 46.

When the golf bag 10 is carried by a person with the first shoulder strap 20 looped over one shoulder of the person and the second shoulder strap 22 looped over the other shoulder of the person, the first and second shoulder straps 20, 22 are arranged to cross each other at an intersection point 48 that is substantially midway between the person's shoulders. This causes the golf bag 10 to be supported evenly by the first and second shoulder straps 20, 22.

Figure 4:
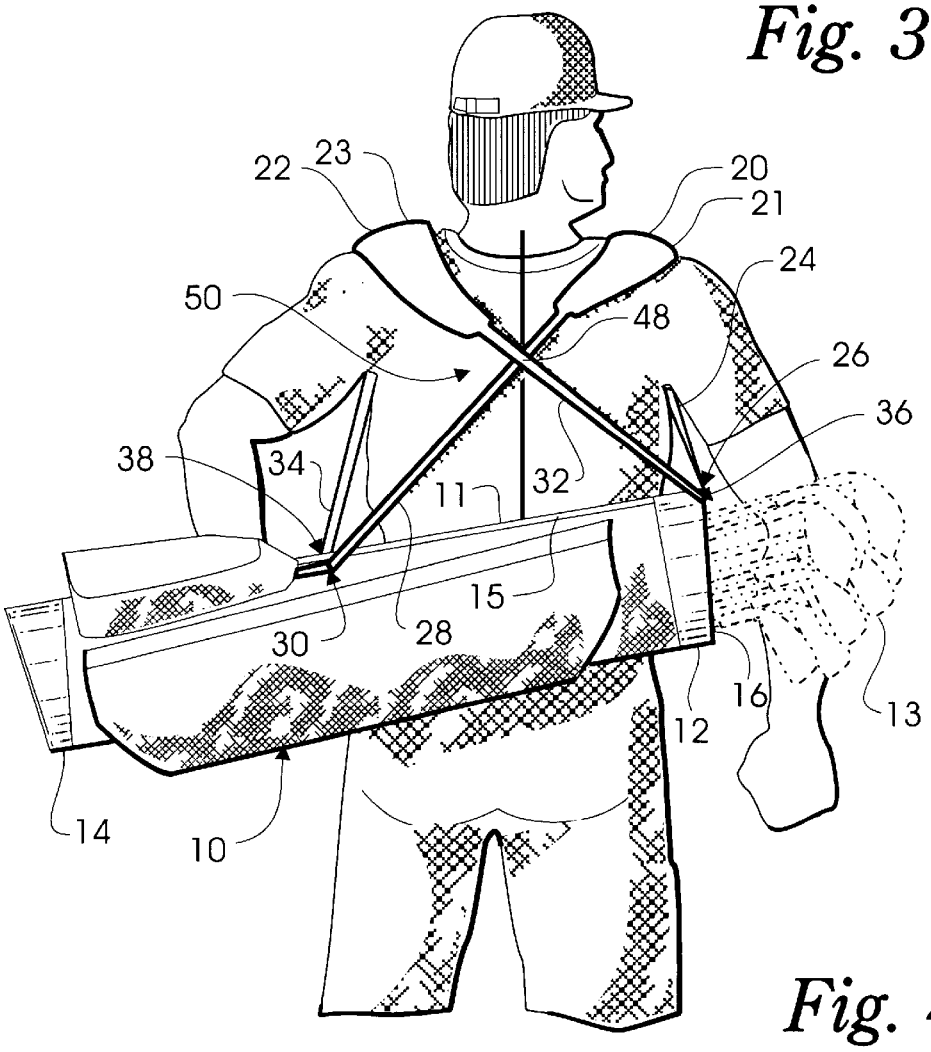
FIG. 4 is a diagrammatic view showing a golf bag employing the dual strap arrangement of FIG. 1 while being carried by a person.

As seen in FIG. 4, the golf bag 10 is preferably carried by a person with the first shoulder strap 20 looped over the person's right shoulder and the second shoulder strap 22 looped over the person's left shoulder. This results in the upper end 32 of the second shoulder strap 22 being considerably longer than the upper end 24 of the first shoulder strap 20 in order to properly position the pad 23 on the person's left shoulder. The shoulder straps 20, 22 form an X-shaped pattern 50 on the person's back.

Since the shoulder straps 20, 22 are independent of each other and are not connected to each other, it will be understood that the golf bag 10 may be carried by utilizing only one of the shoulder straps 20, 22 in conventional manner. This is an important advantage when carrying the golf bag 10 short distances such as from a putting green to the next tee area on a golf course. Also, either one of the shoulder straps 20, 22 may be removed from the golf bag 10 if it is desired to employ a single shoulder strap.

Figure 5:
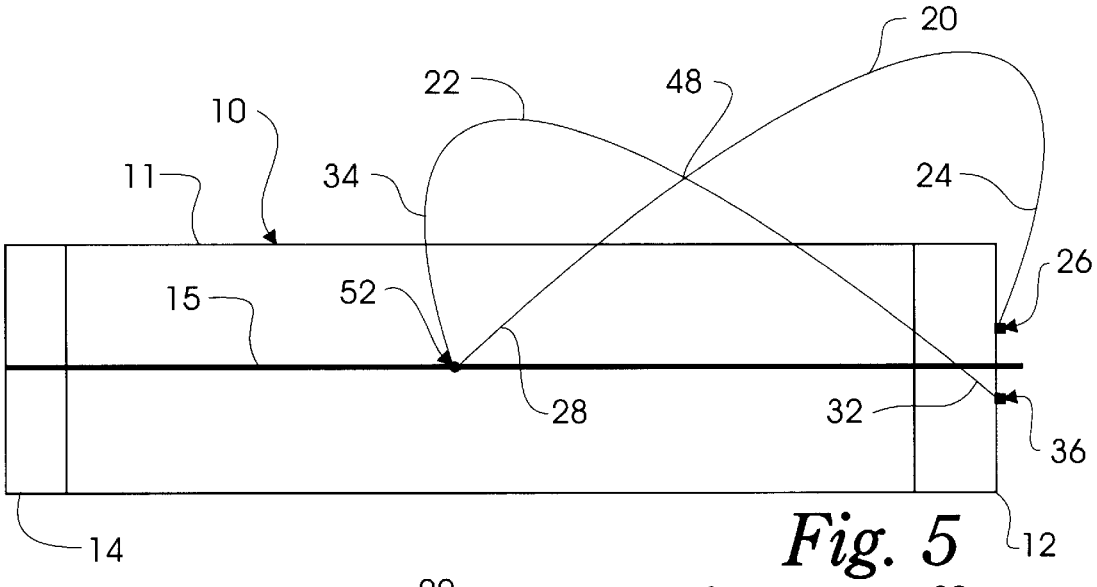
FIGS. 5–9 are schematic views similar to FIG. 3 illustrating dual strap arrangements according to alternative embodiments of the present invention.
Figure 6:
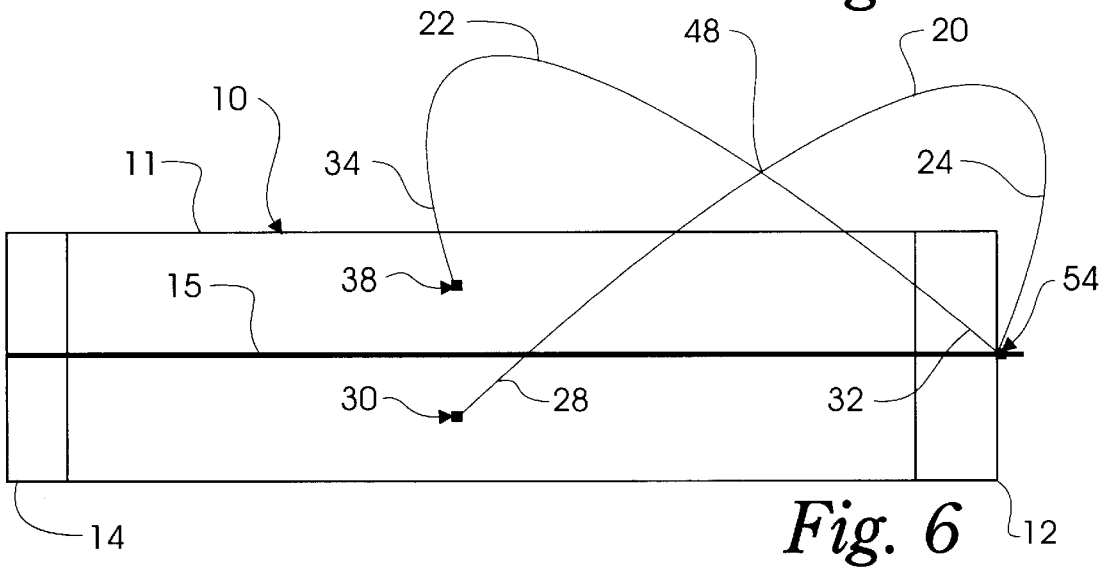
Figure 7:
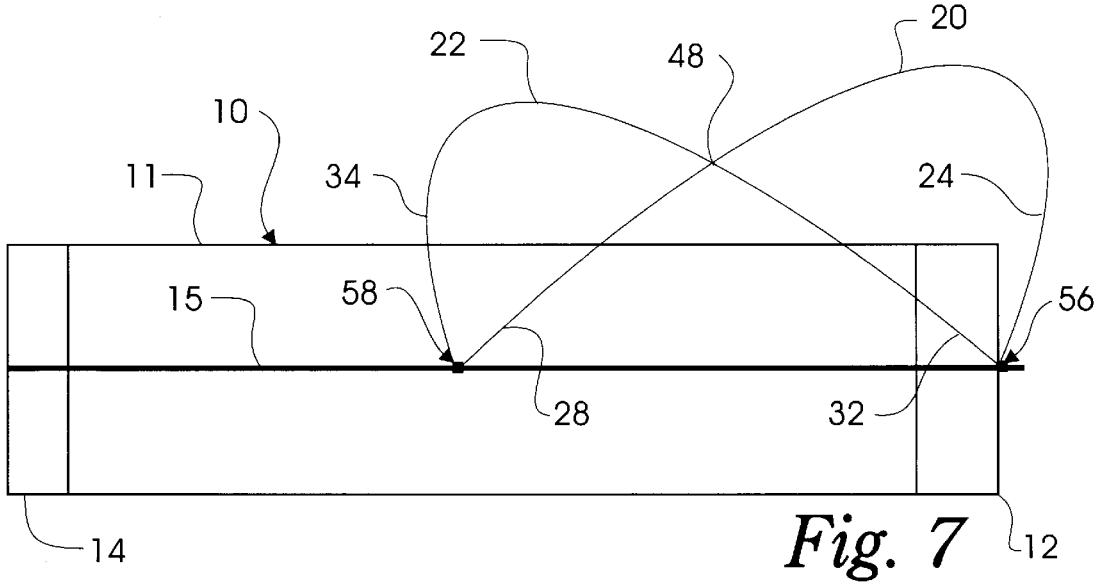

Referring to FIGS. 5–7, three alternative dual strap arrangements are illustrated with each arrangement including the first and second shoulder straps 20, 22 attached to the body 11 of the golf bag 10 in different configurations utilizing some common locations where the ends 24, 28, 32, 34 of the shoulder straps 20, 22 are attached to the body 11. In the dual strap arrangement shown in FIG. 5, the shoulder straps 20, 22 have their upper ends 24, 32 attached to the body 11 proximate its top end 12 at circumferentially spaced locations 26, 36 on opposite sides of the spinal axis 15 but their lower ends 28, 34 are attached to the body 11 at a common location 52 that lies on the spinal axis 15 generally intermediate the body top and bottom ends 12, 14. In the dual strap arrangement shown in FIG. 6, the shoulder straps 20, 22 have their lower ends 28, 34 attached to the body 11 generally intermediate its top and bottom ends 12, 14 at circumferentially spaced locations 30, 38 on opposite sides of the spinal axis 15 but their upper ends 24, 32 are attached to the body 11 at a common location 54 that lies on the spinal axis 15 proximate the body top end 12. In the dual strap arrangement shown in FIG. 7, the shoulder straps 20, 22 have their upper ends 24, 32 attached to the body 11 at a common location 56 that lies on the spinal axis 15 proximate the body top end 12 while their lower ends 28, 34 are attached to the body 11 at another common location 58 that also lies on the spinal axis 15 generally intermediate the body top and bottom ends 12, 14.

Figure 8:
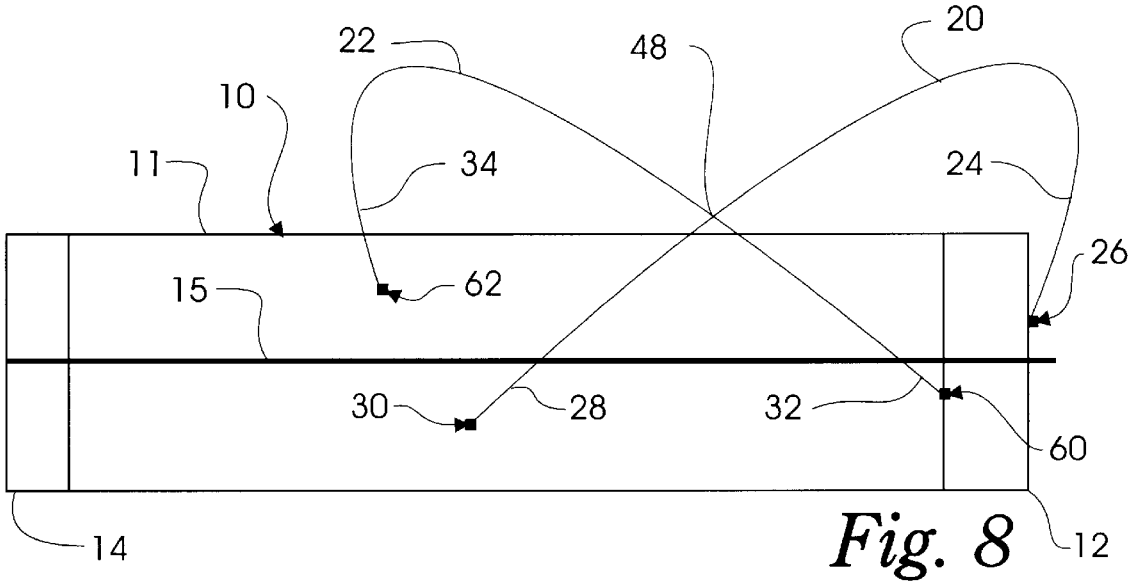
Figure 9:
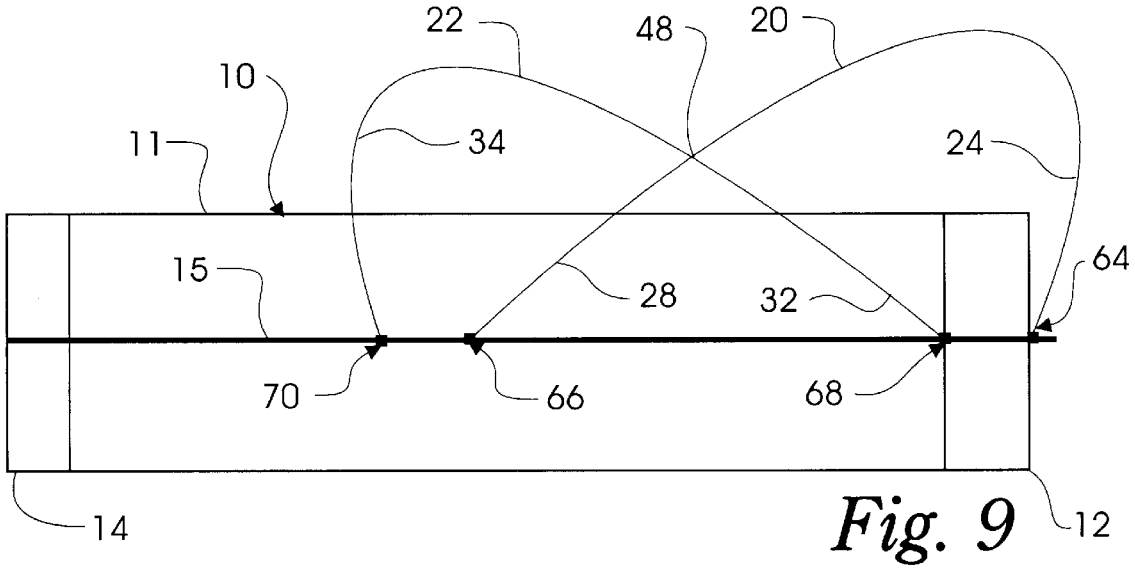

Referring to FIGS. 8 and 9, two alternative dual strap arrangements are illustrated with each arrangement including the first and second shoulder straps 20, 22 attached to the body 11 of the golf bag 10 in different configurations utilizing four separate locations, such as in the dual strap arrangement of FIG. 3, where the ends 24, 28, 32, 34 of the shoulder straps 20, 22 are attached to the body 11. In the dual strap arrangement shown in FIG. 8, the shoulder strap 20 has its upper and lower ends 24, 34 attached to the body 11 at first and second locations 26, 30, respectively, on opposite sides of the spinal axis 15. The shoulder strap 22 has its upper and lower ends 32, 34 attached to the body 11 at third and fourth locations 60, 62, respectively, on opposite sides of the spinal axis 15. The third location 60 is between the first and second locations 26, 30 while the fourth location 62 is between the second location 30 and the bottom end 14 of the body 11. The first and third locations 26, 60 are proximate the body top end 12, and the second and fourth locations 30, 62 are generally intermediate the body top and bottom ends 12, 14. In the dual strap arrangement shown in FIG. 9, the shoulder strap 20 has its upper and lower ends 24, 32 attached to the body 11 at first and second locations 64, 66, respectively, that lie on the spinal axis 15. The shoulder strap 22 has its upper and lower ends 32, 34 attached to the body 11 at third and fourth locations 68, 70, respectively, that also lie on the spinal axis 15. The third location 68 is between the first and second locations 64, 66 while the fourth location 70 is between the second location 66 and the bottom end 14 of the body 11. The first and third locations 64, 68 are proximate the body top end 12, and the second and fourth locations 66, 70 are generally intermediate the body top and bottom ends 12, 14.

It is understood that, in the alternative dual strap arrangements of FIGS. 5–9, the shoulder straps 20, 22 are arranged, when looped over a person's shoulders in the manner illustrated in FIG. 4, to cross each other at the intersection point 48 that is substantially midway between the person's shoulders and form the X-shaped pattern 50 on the person's back.

What is claimed is:

1. In combination with a golf bag for carrying golf clubs wherein the golf bag has a generally tubular body with a top end, a bottom end, and a spinal axis extending longitudinally between said top and bottom ends, a throat structure defining said body top end, said throat structure including divider means for dividing said top end into separate sections, a dual strap arrangement comprising:

a first shoulder strap having an upper end attached to said throat structure at a first location which is on one side of said spinal axis and a lower end attached to said body at a second location which is on the other side of said spinal axis so that a first straight line extending between said first and second locations traverses said spinal axis, said first location being proximate said top end of said body, said second location being generally intermediate said top and bottom ends of said body;

a second shoulder strap having upper and lower ends attached respectively to said throat structure and said body at third and fourth locations, said third location being on the same side of said spinal axis as said second location proximate said top end of said body and circumferentially spaced apart from said first location by a first distance, said fourth location being on the same side of said spinal axis as said first location generally intermediate said top and bottom ends of said body and circumferentially spaced apart from said second location by a second distance so that a second straight line extending between said third and fourth locations also traverses said spinal axis, said second distance being at least equal to said first distance; and said first and second shoulder straps being arranged, when the golf bag is carried by a person with said first shoulder strap looped over one shoulder of the person and said second shoulder strap looped over the other shoulder of the person, to cross each other and form an X-shaped pattern on the person's back with the golf bag disposed substantially horizontally across the person's back.

2. The dual strap arrangement of claim 1, wherein said first and second shoulder straps are arranged so that they cross each other at an intersection point that is substantially midway between the person's shoulders.

3. The dual strap arrangement of claim 1, wherein said first shoulder strap has an overall length measured between said first and second locations, and further comprising first adjustment means for adjusting the overall length of said first shoulder strap.

4. The dual strap arrangement of claim 3, wherein said first adjustment means is disposed on said lower end of said first shoulder strap.

5. The dual strap arrangement of claim 3, wherein said second shoulder strap has an overall length measured between said third and fourth locations, and further comprising second adjustment means for adjusting the overall length of said second shoulder strap.

6. The dual strap arrangement of claim 5, wherein said second adjustment means is disposed on said lower end of said second shoulder strap.

7. The dual strap arrangement of claim 1, wherein said second distance is greater than said first distance.

8. A golf bag for carrying golf clubs, comprising:

a generally tubular body with a top end, a bottom end, and a spinal axis extending between said top and bottom ends;

a throat structure defining said body top end, said throat structure including divider means for dividing said top end into separate sections;

a first shoulder strap having an upper end attached to said throat structure at a first location which is on one side of said spinal axis and a lower end attached to said body at a second location which is on the other side of said spinal axis so that a first straight line extending between said first and second locations traverses said spinal axis, said first location being proximate said top end of said body, said second location being generally intermediate said top and bottom ends of said body;

a second shoulder strap having upper and lower ends attached respectively to said throat structure and said body at third and fourth locations, said third location being on the same side of said spinal axis as said second location proximate said top end of said body and circumferentially spaced apart from said first location by a first distance, said fourth location being on the same side of said spinal axis as said first location generally intermediate said top and bottom ends of said body and circumferentially spaced apart from said second location by a second distance so that a second straight line extending between said third and fourth locations also traverses said spinal axis, said second distance being at least equal to said first distance; and said first and second shoulder straps being arranged, when the golf bag is carried by a person with said first shoulder strap looped over one shoulder of the person and said second shoulder strap looped over the other shoulder of the person, to cross each other and form an X-shaped pattern on the person's back with the golf bag disposed substantially horizontally across the person's back.

9. The golf bag of claim 8, wherein said throat structure comprises a pair of slots formed therein at said first and third locations, and wherein said upper ends of said first and second shoulder straps are secured in said slots.

* * * * *